US009938751B2

(12) United States Patent
Chow

(10) Patent No.: US 9,938,751 B2
(45) Date of Patent: Apr. 10, 2018

(54) TAMPER RESISTANT LOCKING DEVICE

(71) Applicant: Leslie Ho Leung Chow, Shilouzhen Panyu District (CN)

(72) Inventor: Leslie Ho Leung Chow, Shilouzhen Panyu District (CN)

( * ) Notice: Subject to any disclaimer, the term of this patent is extended or adjusted under 35 U.S.C. 154(b) by 297 days.

(21) Appl. No.: 14/958,820

(22) Filed: Dec. 3, 2015

(65) Prior Publication Data

US 2016/0281390 A1 Sep. 29, 2016

Related U.S. Application Data

(63) Continuation-in-part of application No. 14/667,218, filed on Mar. 24, 2015, now Pat. No. 9,803,393.

(51) Int. Cl.
*E05B 17/00* (2006.01)
*E05B 27/00* (2006.01)
(Continued)

(52) U.S. Cl.
CPC ..... *E05B 27/0075* (2013.01); *E05B 15/006* (2013.01); *E05B 15/06* (2013.01);
(Continued)

(58) Field of Classification Search
CPC .. E05B 15/06; E05B 17/0054; E05B 17/0058; E05B 2017/0095; E05B 27/0057;
(Continued)

(56) References Cited

U.S. PATENT DOCUMENTS 5,351,042 A * 9/1994 Aston ..... E05B 47/063 340/5.61
6,058,752 A * 5/2000 Feder ..... E05B 15/08 70/419

(Continued)

*Primary Examiner* — Christopher J Boswell
(74) *Attorney, Agent, or Firm* — John R. Ross; John R. Ross, III

(57) ABSTRACT

A tamper resistant lock. A lock has a lock housing with housing indentation. A cylinder is rotatably housed within the housing. A locking pin is connected to the cylinder and is inserted into the housing indentation when the lock is in a locked position and the locking pin is clear of the housing indentation when the lock is in an unlocked position. An anti-tampering mechanism is positioned between the housing and the cylinder. The anti-tampering mechanism receives a user's key and also includes a relative motion hole. A key extension portion is rotatably inserted inside the anti-tampering mechanism body and includes a relative motion indentation. The key extension portion is keyed to the cylinder. A lock ball is inserted into the relative motion hole and the relative motion indention, thereby preventing relative motion between the anti-tampering mechanism body and the key extension portion. A flexible band is wrapped around the anti-tampering mechanism body and covers the lock ball and holds the lock ball in place in the relative motion hole and relative motion indentation. The flexibility of the flexible band is sufficient to permit the lock ball to leave the relative motion indentation while simultaneously retaining the lock ball in the relative motion hole if the anti-tampering mechanism body is rotated while the locking pin is inserted into the housing indentation, thereby permitting relative motion between the anti-tampering mechanism body and the key extension portion. In a preferred embodiment the tamper resistant lock is a padlock.

9 Claims, 17 Drawing Sheets

(51) Int. Cl.

| | |
|---|---|
| ***E05B 51/00*** | (2006.01) |
| ***E05B 49/00*** | (2006.01) |
| ***E05B 47/06*** | (2006.01) |
| ***E05B 15/06*** | (2006.01) |
| ***E05B 47/00*** | (2006.01) |
| ***E05B 15/00*** | (2006.01) |
| *E05B 67/06* | (2006.01) |

(52) U.S. Cl.
CPC ..... *E05B 17/0058* (2013.01); *E05B 17/0062* (2013.01); *E05B 47/0009* (2013.01); *E05B 47/0611* (2013.01); *E05B 47/0623* (2013.01); *E05B 47/0626* (2013.01); *E05B 49/002* (2013.01); *E05B 51/005* (2013.01); *E05B 67/063* (2013.01); *E05B 2047/0048* (2013.01); *E05B 2047/0093* (2013.01)

(58) Field of Classification Search
CPC ..... E05B 27/0067; E05B 27/47; E05B 27/00; E05B 27/0009; E05B 27/0011; E05B 27/06; E05B 27/0603; E05B 27/0001; E05B 27/0611; E05B 27/063; E05B 27/2047; E05B 27/036; E05B 27/0037; E05B 27/0048; E05B 27/0058; E05B 27/0072; E05B 27/0073; E05B 27/0083; E05B 27/0084; E05B 49/00; E05B 49/002; E05B 49/004; E05B 51/005
See application file for complete search history.

(56) References Cited

U.S. PATENT DOCUMENTS

| | | | | |
|---|---|---|---|---|
| 7,406,846 | B2 * | 8/2008 | Chu | E05B 47/0009 70/278.1 |
| 7,454,934 | B2 * | 11/2008 | Lin | E05B 27/005 70/351 |
| 7,475,579 | B2 * | 1/2009 | Miao | E05B 1/0038 70/360 |
| 7,690,231 | B1 * | 4/2010 | Field | E05B 47/0009 292/DIG. 66 |
| 7,698,916 | B2 * | 4/2010 | Davis | E05B 17/0058 70/34 |
| 8,393,189 | B1 * | 3/2013 | Lin | E05B 27/0032 70/356 |
| 9,038,427 | B2 * | 5/2015 | Shen | E05B 27/0075 70/358 |
| 9,133,648 | B2 * | 9/2015 | Maltaverne | E05B 17/0058 |

* cited by examiner 20
12d
89
11
48
12
25
46
2
29
49
44
43
23
35
1
21
26
27
24
38
51

TAMPER RESISTANT LOCKING DEVICE

The present invention relates to locking devices, and in particular, to tamper resistant locking devices. The present invention is a Continuation-in-Part (CIP) of U.S. patent application Ser. No. 14/667,218, filed Mar. 24, 2015, the specification of which is incorporated by reference herein.

BACKGROUND OF THE INVENTION

Prior Art Electromechanical Locking Devices

Electromechanical locking devices are known and include electrically interfaced or controlled release mechanisms for operating a lock cylinder. For example, U.S. Pat. No. 4,712,398 discloses an electronic locking system comprising a lock cylinder with a rotatable plug located therein. An electronically activated release assembly is provided which selectively disengages a locking pin from the plug to allow turning of the key to rotate the plug relative to the cylinder. The lock cylinder and key each include an electronic memory device containing keying system codes. Upon insertion of the key the release mechanism disengages the locking pin from the plug to allow its rotation. U.S. Pat. No. 5,552,777 discloses another type of electromechanical cylinder lock having a blocking pin and an electromagnetic solenoid in the cylinder plug. The blocking pin extends into a recess in the cylinder shell, and is retracted upon actuation of the solenoid by a microprocessor in the key.

One benefit of including electronic control features in locks is that an electronic record can be kept of lock usage. Also, electronic control features in locks provides for the ability to have increased keying codes for operating the lock. For example, information can be stored in the lock and/or key such that the locking mechanism is activated in response to detecting and/or exchanging data. As the information stored in the components may be altered, it is possible to vary the keying codes without changing the system hardware. In contrast, changing the mechanical keying codes in a purely mechanical lock typically requires forming a new key with different bitting surfaces, a more involved process than reprogramming electronic components of an electromechanical lock.

Nitinol Wire

Nitinol Wire (also known as 'Muscle Wire' or 'Memory Wire') is a thin strand of a special shape memory alloy composed primarily of Nickel (Ni) and Titanium (Ti). Nitinol Wire will shorten in length after receiving an electrical signal, or heated by other means. Nitinol wire returns to its original length the electrical signal is removed and/or cooled.

All locks are susceptible to tampering. For a lock to be effective, it must include features to thwart unwanted tampering and destruction.

What is needed is an improved locking device that includes an effective anti-tampering mechanism.

SUMMARY OF THE INVENTION

The present invention provides a tamper resistant lock. A lock has a lock housing with housing indentation. A cylinder is rotatably housed within the housing. A locking pin is connected to the cylinder and is inserted into the housing indentation when the lock is in a locked position and the locking pin is clear of the housing indentation when the lock is in an unlocked position. An anti-tampering mechanism is positioned between the housing and the cylinder. The anti-tampering mechanism receives a user's key and also includes a relative motion hole. A key extension portion is rotatably inserted inside the anti-tampering mechanism body and includes a relative motion indentation. The key extension portion is keyed to the cylinder. A lock ball is inserted into the relative motion hole and the relative motion indention, thereby preventing relative motion between the anti-tampering mechanism body and the key extension portion. A flexible band is wrapped around the anti-tampering mechanism body and covers the lock ball and holds the lock ball in place in the relative motion hole and relative motion indentation. The flexibility of the flexible band is sufficient to permit the lock ball to leave the relative motion indentation while simultaneously retaining the lock ball in the relative motion hole if the anti-tampering mechanism body is rotated while the locking pin is inserted into the housing indentation, thereby permitting relative motion between the anti-tampering mechanism body and the key extension portion. In a preferred embodiment the tamper resistant lock is a padlock.

DETAILED DESCRIPTION OF THE PREFERRED EMBODIMENTS

Figures 1A, 1B, 1C, 1D, 1E, 1F, 1G:
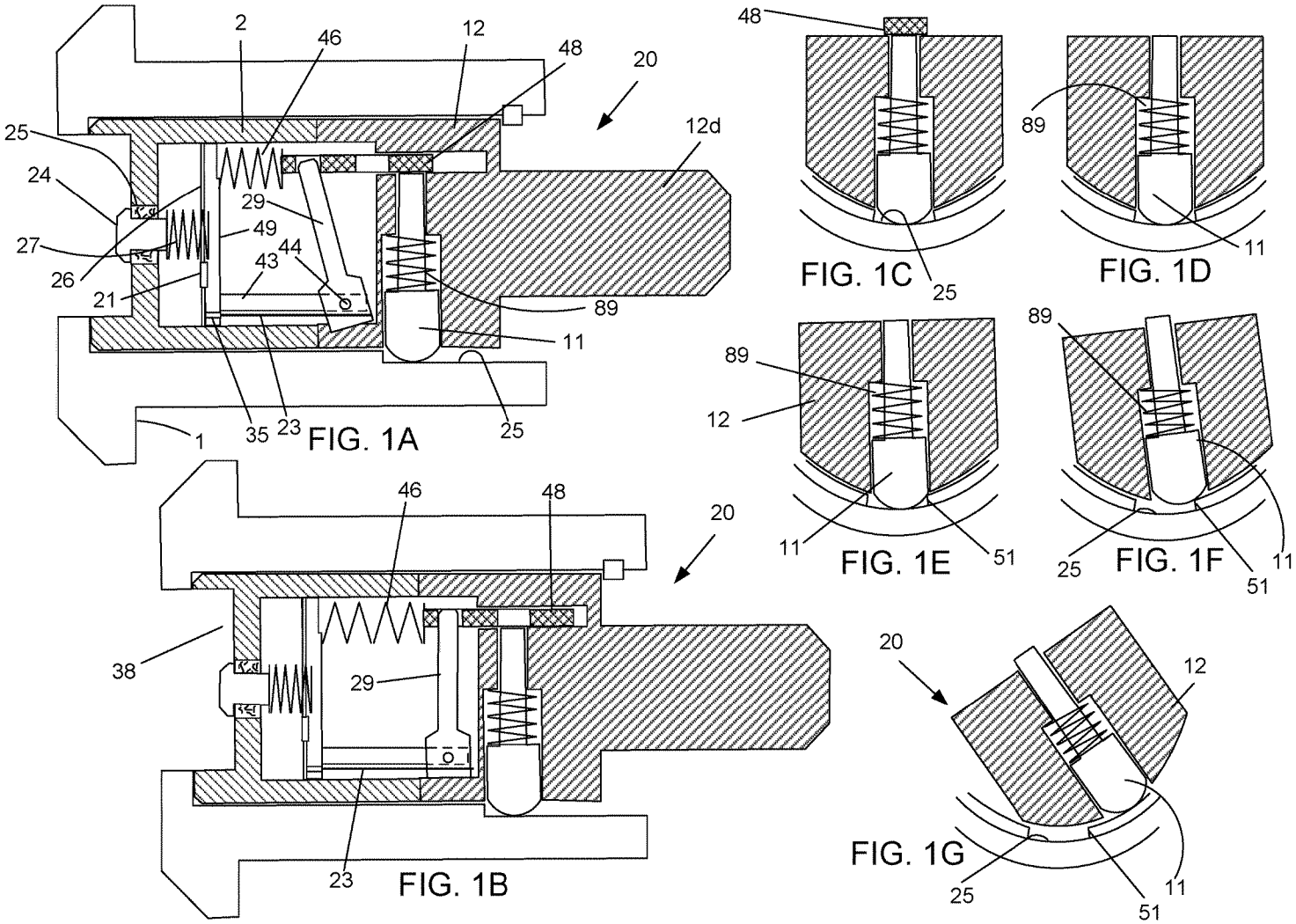
FIGS. 1A-1G show a preferred embodiment of the present invention.
Figure 2:
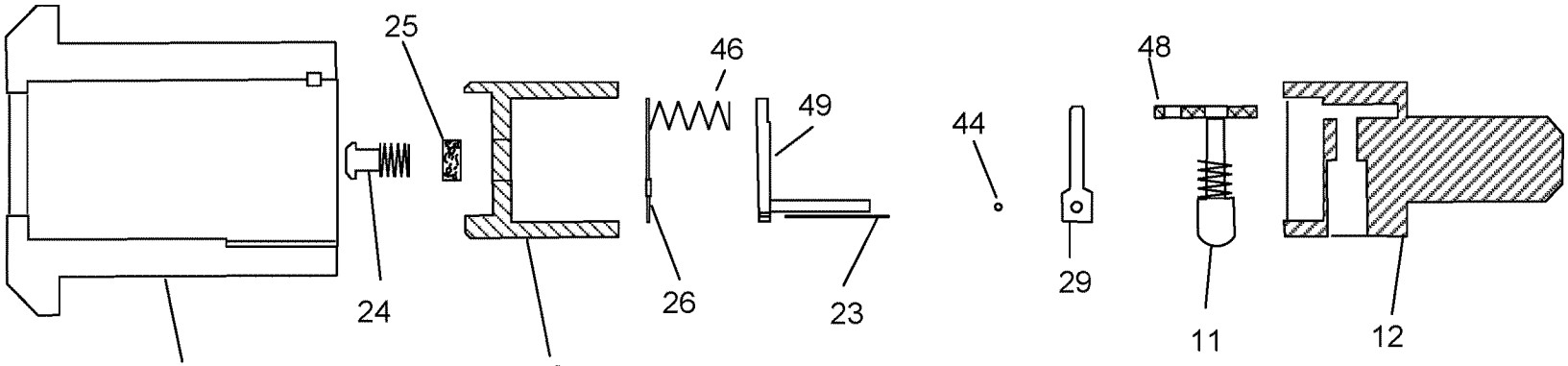
FIG. 2 shows an exploded view of a preferred lock.
Figure 4B:
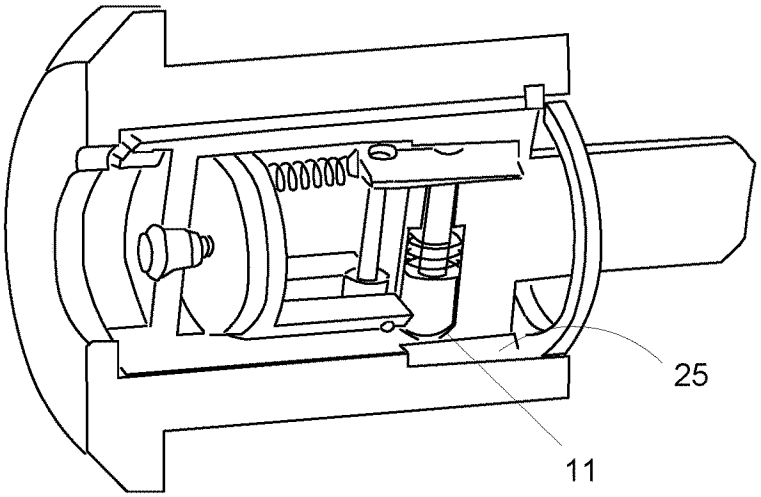
FIGS. 4A and 4B show a perspective view of a preferred embodiment of the present invention.
Figure 4A:
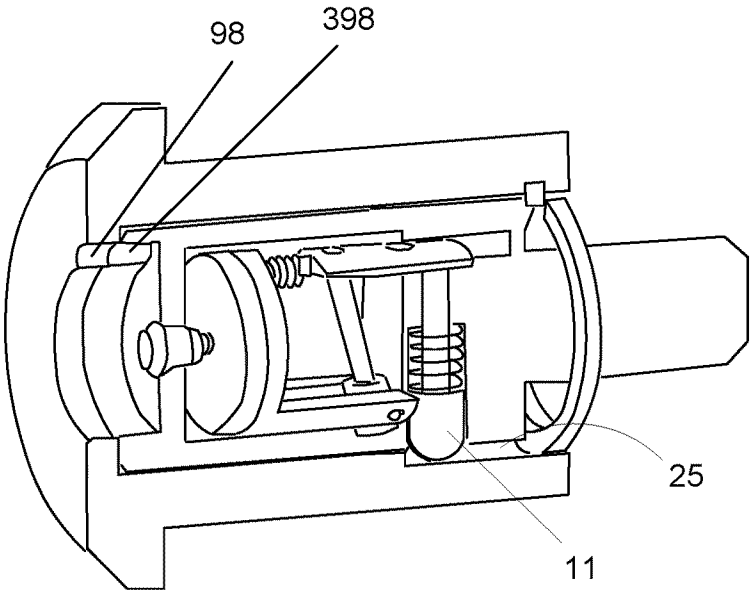

FIG. 1A shows a side view of a preferred lock 20 in a locked position and FIG. 2 shows an exploded view of a preferred lock 20. In FIG. 1A, inner body 2 is rigidly engaged with lower inner body 12. Inner body 2 and lower inner body 12 are rotatably housed within outer shell 1 and form the lock cylinder. Inner body 2 includes indentation 398 that aligns with indentation 98 of outer shell 1 in the locked position (FIG. 4A). Outer shell 1 is preferably rigidly attached to the object being locked, such as a safe door. In a preferred embodiment, lower inner body 12 includes extension 12*d* which preferably engages a latch (not shown). As a key is turned and lower inner body 12 is rotated, the latch will slide free to open the door.

In the locked position, locking pin 11 is inserted into indentation 25 (FIG. 1A, FIG. 4A) cut into outer shell 1, which prevents the rotation of inner body 2 and lower inner body 12. Inner body 2 and lower inner body 12 cannot be rotated until locking pin 11 is raised clear of indentation 25.

Figure 5A:
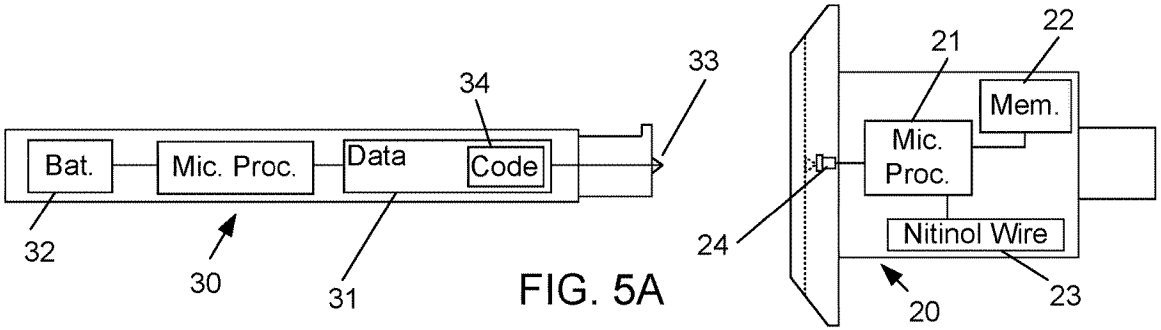
FIGS. 5A and 5B show a preferred key and a preferred lock.
Figure 5B:
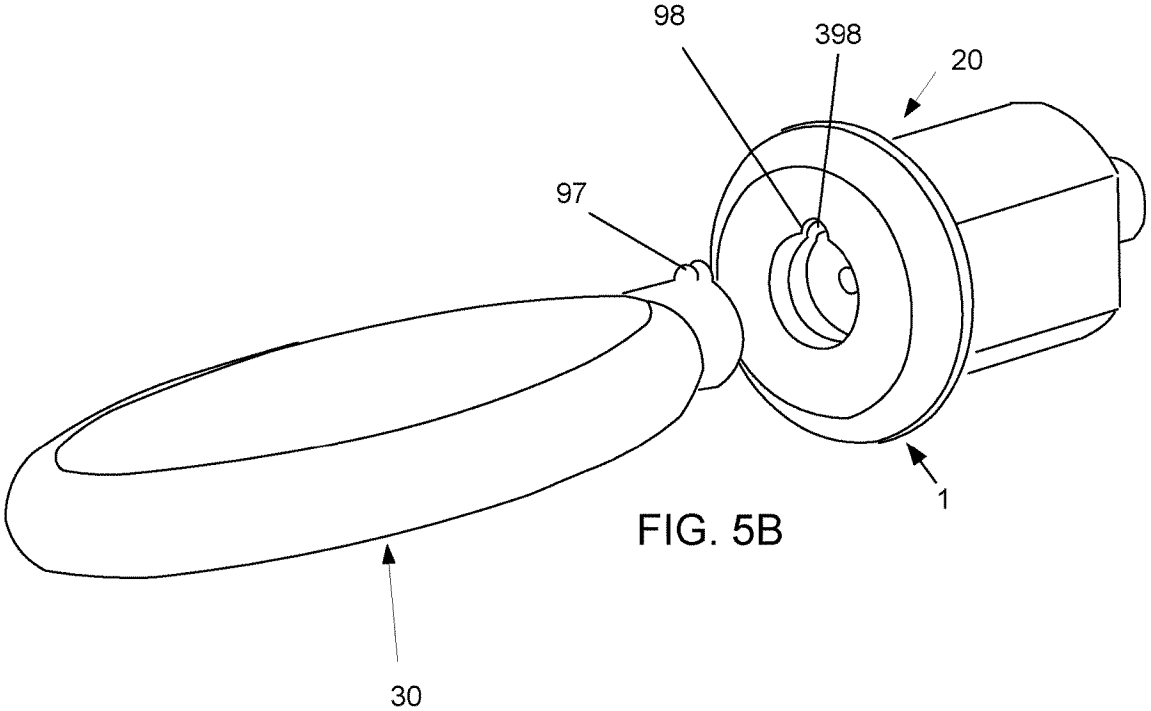

To unlock lock 20 the user inserts key 30 into lock 20 as shown in FIGS. 5A and 5B. A key specific ID code 34 identifying key 30 is stored in database 31. Key 30 is powered by battery 32. Microprocessor 30 includes programming to transfer the key's ID code 34 through contact tip 33 to lock 20 when key 30 is inserted into the lock. Lock 20 includes contact pin 24, microprocessor 21, memory 22 and nitinol wire 23. Microprocessor 21 includes programming to receive ID code 34 and compare it against a list of acceptable codes stored in memory 22. If ID code 34 does not match an acceptable code, then microprocessor 21 will not transfer power to nitinol wire 23 and lock 20 will remain locked. However, if ID code 34 is verified, then microprocessor will allow power to be transmitted to nitinol wire 23. The user will then be able to turn the key and open the lock.

As key 30 is inserted into lock 20, contact tip 33 makes contact with contact pin 24. Contact pin 24 is surrounded and insulated by insulator 25 (FIG. 1A). An electrical signal is transmitted from contact tip 33 through contact pin 24 and then through contact spring 27 to printed circuit board (PCB) 26. PCB 26 is mounted onto PCB frame 49. Microprocessor 21 is mounted on PCB 26 and receives the electrical signal. As stated above, if ID code 34 does not match an acceptable code, then microprocessor 21 will not transfer power to nitinol wire 23 and lock 20 will remain locked. However, if ID code 34 is verified, then microprocessor will allow power to be transmitted to nitinol wire 23.

Nitinol Wire Contraction

Figure 6B:
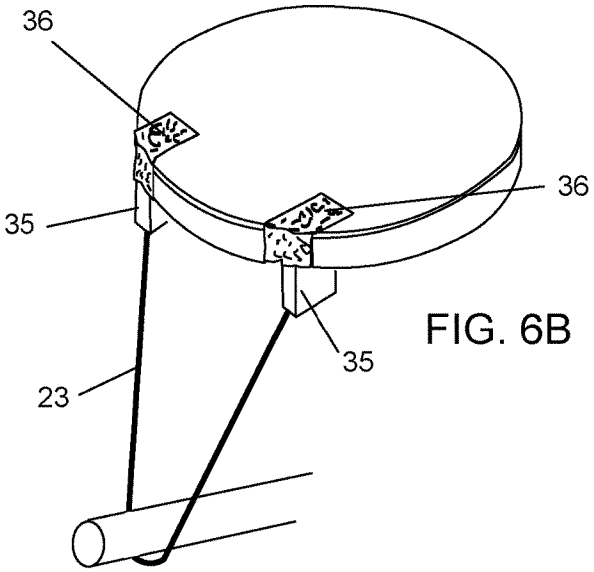
FIGS. 6A and 6B show the mounting of a preferred nitinol wire.
Figure 6A:
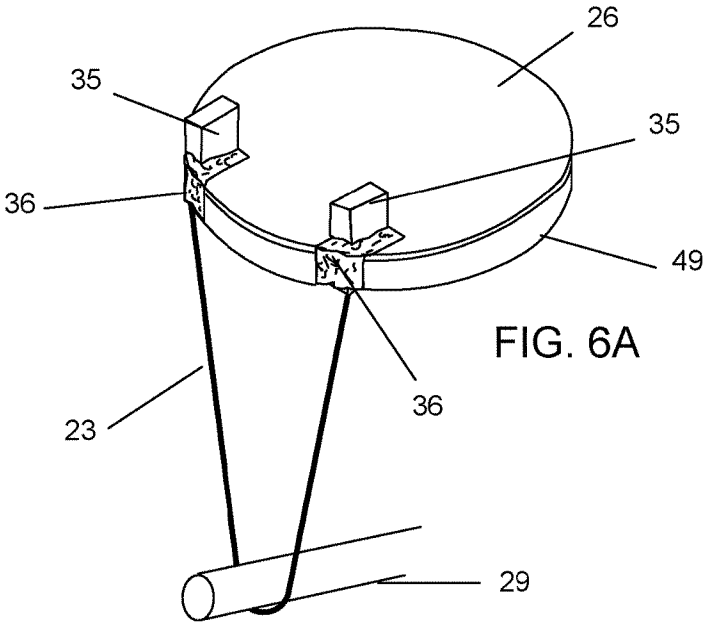

Power is transmitted to nitinol wire 23 from microprocessor 21 (FIG. 1A) through electronic connections on PCB 26. In a preferred embodiment nitinol wire 23 is looped around driver arm 29 and connected to PCB 26 via nitinol wire crimps 35. In a preferred embodiment, crimps 35 are soldered to PCB 26 via low melt solder 36 (FIG. 6A). The purpose of the low melt connection is to prevent a thief from opening lock 20 by merely heating lock 20. In the event nitinol lock 20 is heated, low melt solder 36 will melt, causing crimps 35 to move downward. Nitinol wire 23 will contract due to the heat, however because crimps 35 have lowered there will not be enough force to move driver arm 29 (FIG. 6B).

As shown in FIGS. 1A and 1B, driver arm 29 is pivotally connected to driver arm support bracket 43 via pivot axis 44. Before power is supplied to nitinol wire 23, jam plate 48 covers locking pin 11 and blocks upward movement of locking pin 11 (FIGS. 1A and 1C). After power is directed to nitinol wire 23, nitinol wire 23 contracts causing driver arm 29 to pivot clockwise (FIG. 1B). Jam plate 48 is connected to PCB 26 via return spring 46. The clockwise pivoting of driver arm 29 causes jam plate 48 to move rightward so that locking pin 11 is no longer blocked by jam plate 48 (FIGS. 1B and 1D).

Once jam plate 48 is no longer covering locking pin 11, the user is able to turn key 30. The turning of key 30 causes lower inner body 12 to also turn (FIGS. 1E-1G). In FIG. 1E, locking pin 11 has made contact with edge 51 of indentation 25. In FIG. 1F, edge 51 is pushing locking pin 11 upwards and clear of indentation 25 and compressing spring 89. In FIG. 1G, lower inner body 12 has turned and locking pin 11 is clear of indentation 25. Locking spring 52 is compressed between locking pin 11 and lower inner body 12. Lock 20 is in an unlocked position in FIG. 1G.

Removing the Key and Re-Locking the Lock

To place lock 20 in the locked position the user turns key 30 (FIG. 5B) so that nodule 97 on key 30 and indentation 398 on inner body 2 is aligned with alignment indentation 98 on outer shell 1. The user is then able to remove key 30.

As the user turns key 30 from the unlocked position to the locked position, locking pin 11 moves from the position shown in FIG. 1G to the position shown in FIG. 1D. Spring 89 is compressed and therefore pushes locking pin 11 downward into indentation 25. When the locking pin is in the position shown in FIG. 1D, the user may remove key 30 from the lock. Power is then no longer supplied to nitinol wire 23. Therefore nitinol wire 23 will expand. Spring 46 is biased and will pull jam plate to the left (FIG. 1A) so that it covers locking pin 11 (FIG. 1A and 1C). Lock 20 is now locked.

Driver Arm Moves Away from Lock Face

It should be noted that driver arm 29 rotates clockwise so that it moves jam plate 48 to the right and away from lock face 38 (FIG. 1B) to unlock lock 20. This is a security feature that prevents lock 20 from being shocked or impacted open if lock face 38 is struck suddenly by a thief.

Engagement Tabs

Figures 3A, 3B:
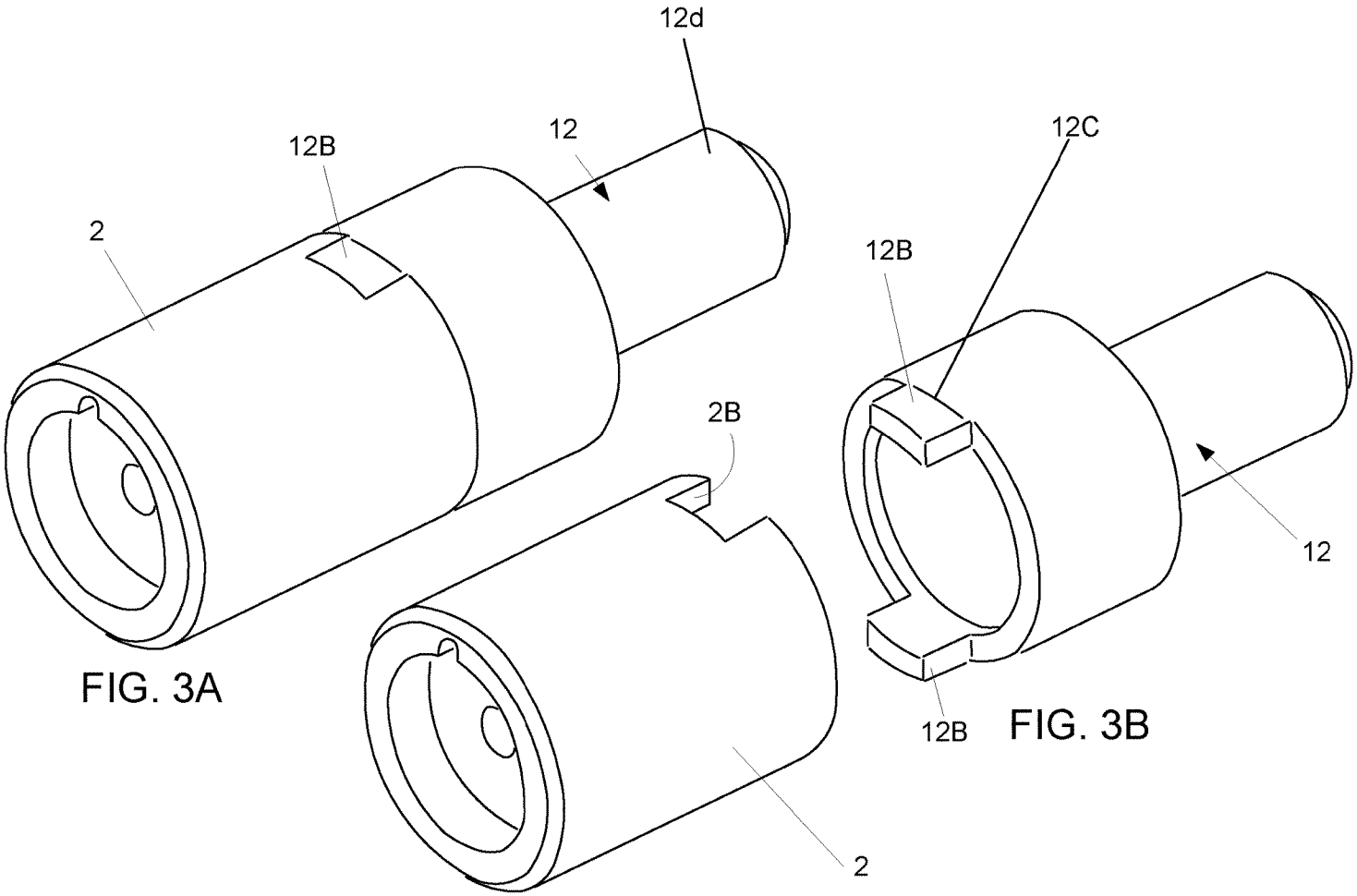
FIGS. 3A and 3B show a preferred inner body and lower inner body.

In a preferred embodiment tabs 12B engage with notches 2B to rigidly hold inner body 2 connected to lower inner body 12 (see also FIGS. 3A and 3B). If a thief tries to force open lock 20 by forcing the rotation of the key when the lock is in the locked position, tabs 12B will break along fracture line 12C leaving lock 20 in a secure position. Fracture line 12C is a weak connection between tabs 12B and lower inner body 12 allowing for the break.

Alternative Outer Shells for Key Removal

Figures 7A, 7B, 7C:
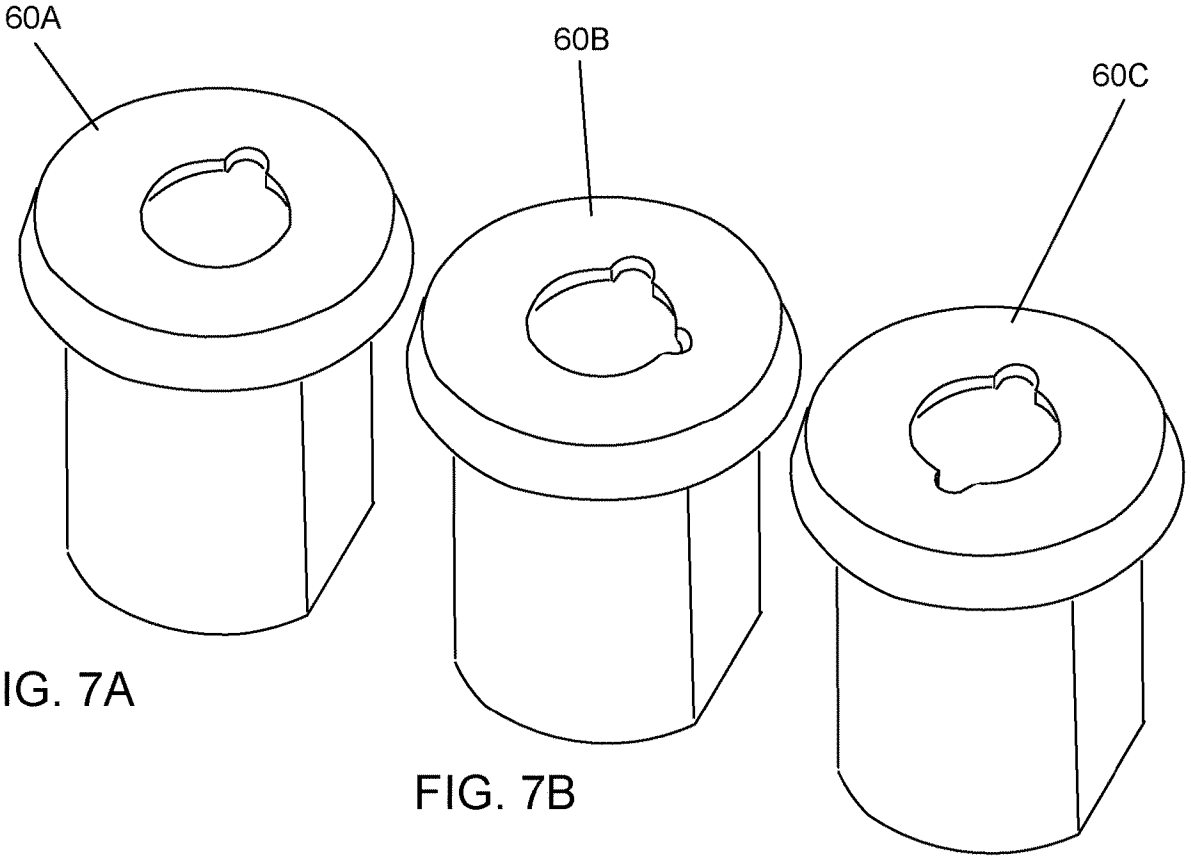
FIGS. 7A-7C show preferred outer shells.

FIGS. 7A-7C show alternative outer shells 60A-60C. It is also possible to alter the outer shell to accommodate so that key 30 can be removed from the shell at a variety of possible positions. For example, in FIG. 7A key 30 can be removed at the 12 o'clock position. In FIG. 7B, key 30 can be removed at either the 12 o'clock position or 3 o'clock position. In FIG. 7C, key 30 can be removed at either the 12 o'clock position or the 6 o'clock position.

Flexible Drive Arm

Figure 8:
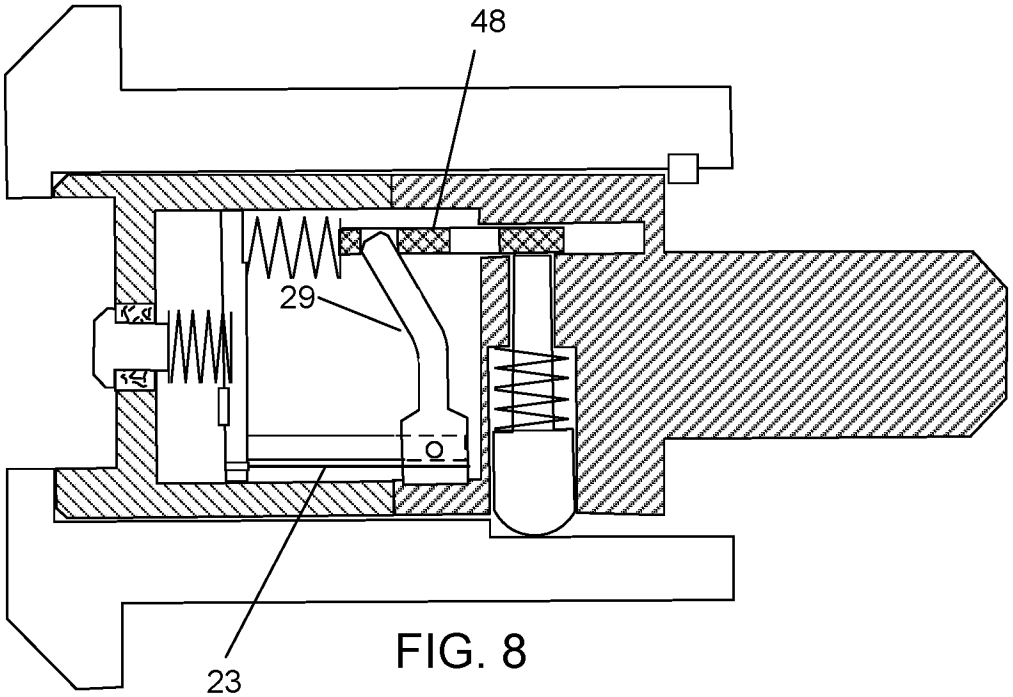
FIG. 8 shows a flexible driver arm.

It is also possible to utilize a flexible drive arm 29. This will prevent unwanted strain being applied to the wire. This will prevent breakage or stretching of nitinol wire 23 in the event jam plate 48 becomes stuck or jammed (see FIG. 8).

Alternative Electrical Actuators Embodiment

Figure 9A:
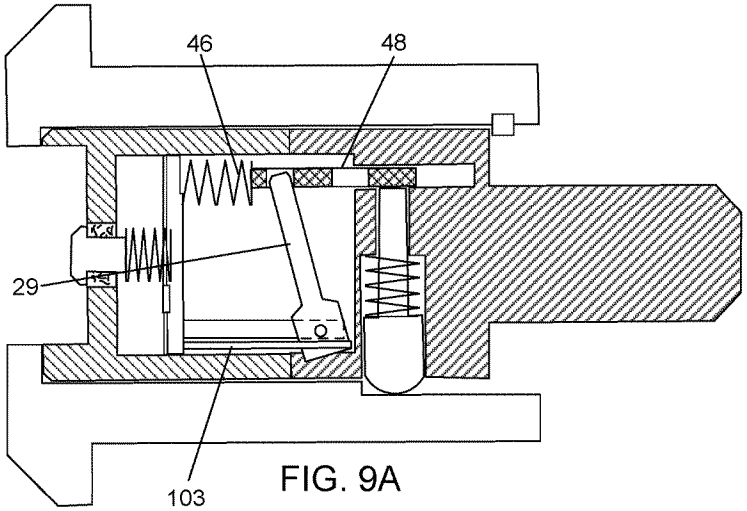
FIGS. 9A-9B show another preferred embodiment of the present invention.
Figure 9B:
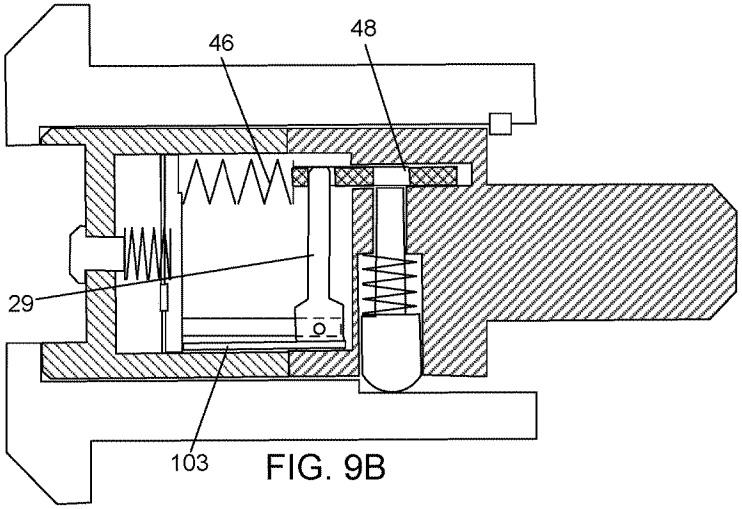

In another preferred embodiment rather than nitinol wire 23, electrical actuator 103 may be utilized to move jam plate 48 (FIGS. 9A and 9B). As the electrical actuator is actuated, jam plate 48 moves between the positions shown in FIGS. 9A and 9B. The lock functions in a fashion similar to that already described above. Electrical actuator 103 be any other form of electrical actuator to move drive arm 29. For example electrical actuator 103 may be a solenoid, a piezo linear actuator or other electrical motor.

Other Preferred Features

It should be noted that the inner assembly of lock 20 is very compact with few moving parts, and is very modular. Also in a preferred embodiment, as an additional security feature no magnetic parts are used for the internal mechanisms of lock 20. Prior art locks are usually affected by magnets. Also it should be noted that there is no power source in lock 20, rather the power is supplied by the key as it is inserted. This is preferable because there are therefore no requirements to recharge or change a power source in lock 20.

Alternate Engagement Tabs

Figures 10A, 10B, 10C:
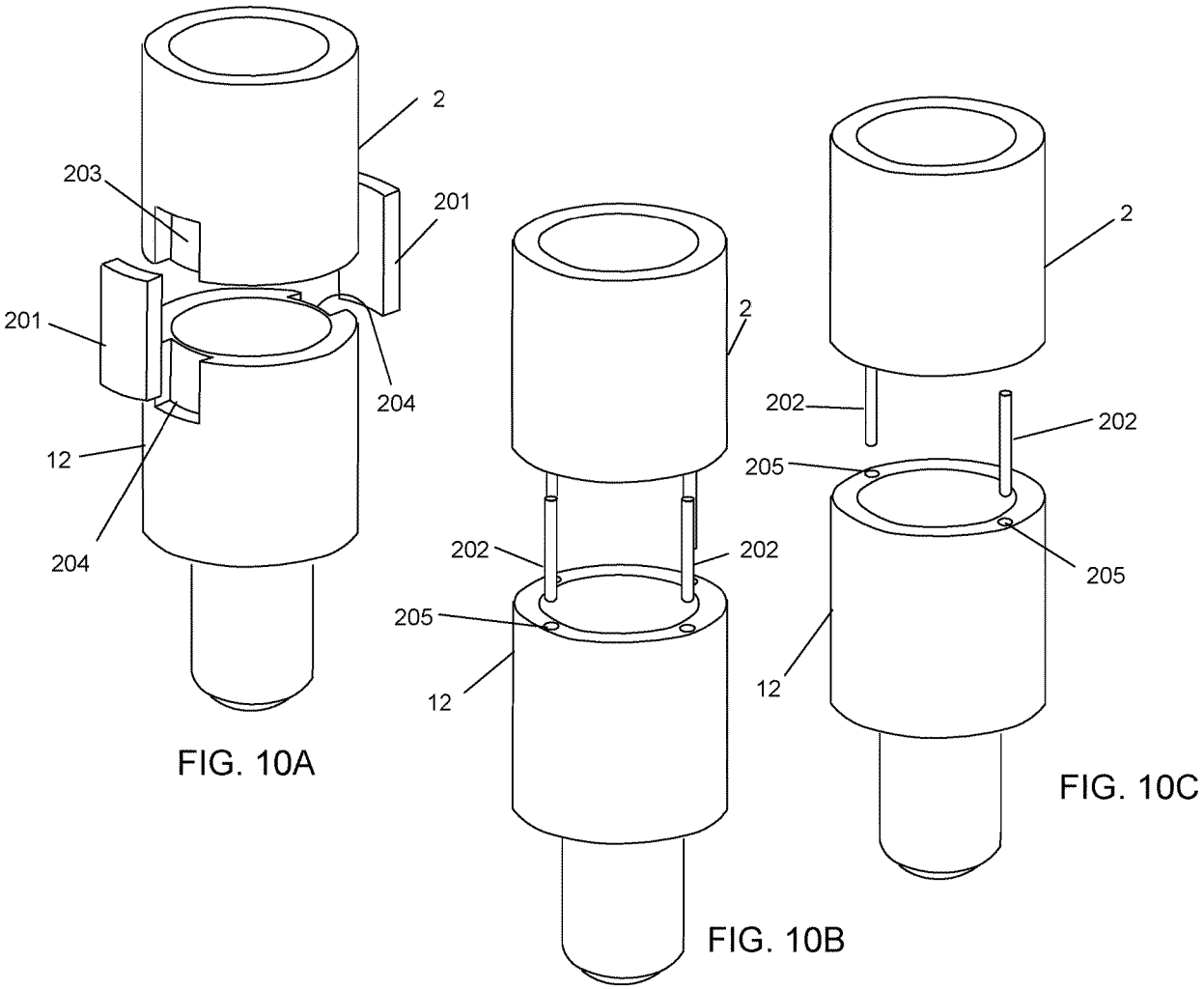
FIGS. 10A-10C show preferred engagement tabs.

FIGS. 10A-10C show the utilization of alternate engagement tabs. If a thief tries to force open lock 20 by forcing the rotation of the key when the lock is in the locked position, the engagement tabs will break leaving lock 20 in a secure position. For example, in FIG. 10A, engagement tabs 201 are inserted into slots 203 of inner body 2 and slots 204 if lower inner body 12. Engagement tabs 201 are fabricated from a weaker material than inner body 2 and lower inner body 12 so that tabs 201 will break if forced by a thief, leaving lock 20 in a secure position.

Also, in FIGS. 10B and 10C, engagement tabs 202 are inserted into holes 205 of inner body 2 and of lower inner body 12. Engagement tabs 202 are fabricated from a weaker material than inner body 2 and lower inner body 12 so that tabs 202 will break if forced by a thief, leaving lock 20 in a secure position.

Anti-Theft Security Device for Electronic Lock

The use of engagement tabs depicted in FIGS. 3A-3B and 10A-10C is an excellent way to thwart thievery and to maintain lock 20 in a locked position. However, once the engagement tabs break, they will need to be replaced to make the lock openable again. This requires work, time and expense.

Figure 11:
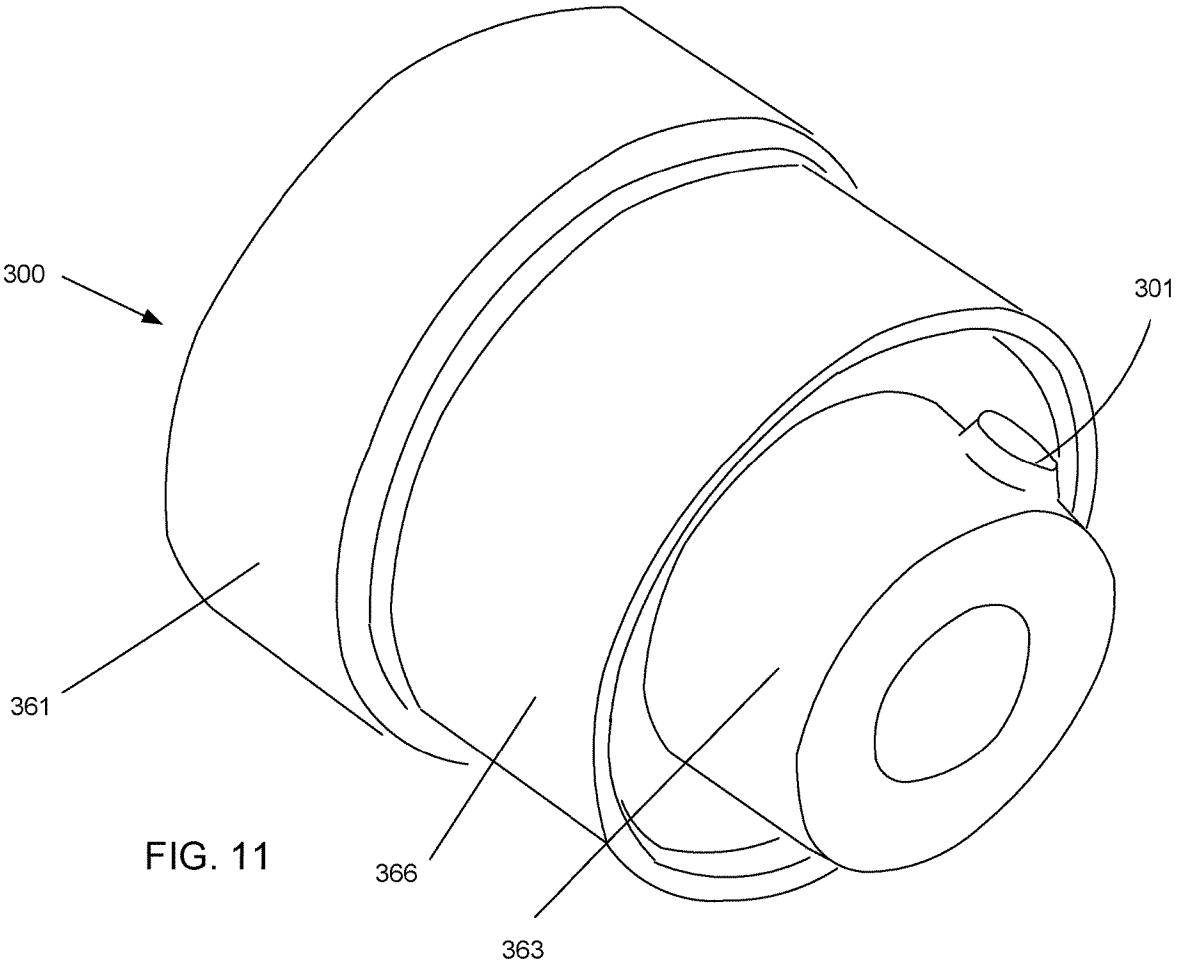
FIGS. 11-13B show a preferred tamper resistant mechanism.
Figure 14:
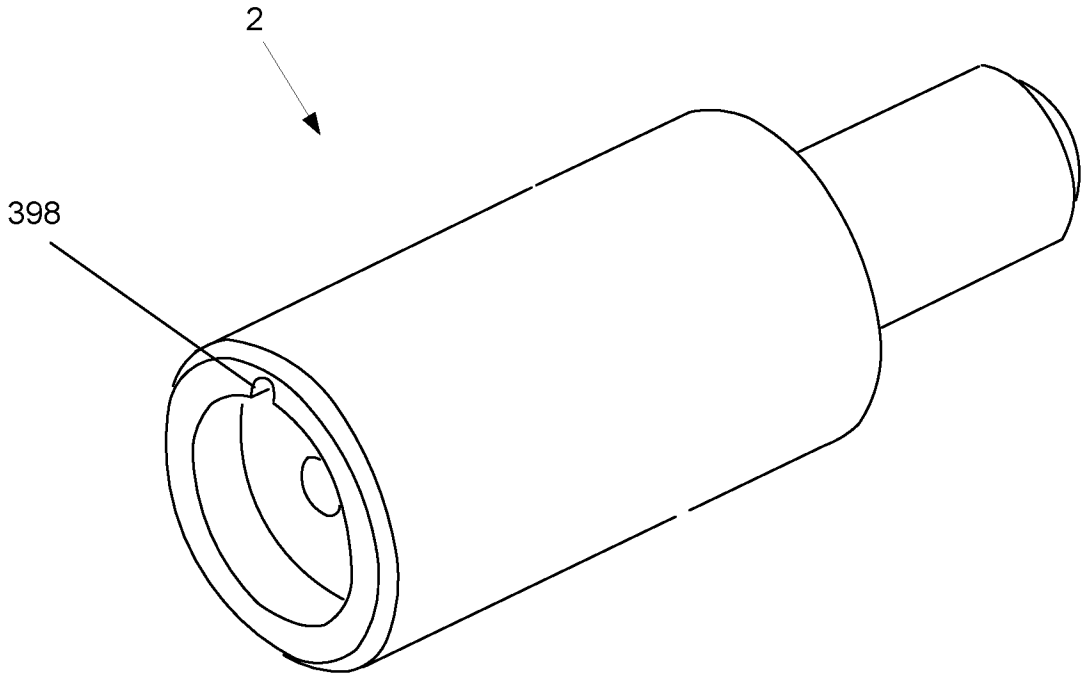
FIG. 14 shows a preferred inner body.

FIG. 11 shows lock anti-tampering mechanism 300. Anti-tampering mechanism 300 is keyed to attach to the face of inner body 2. For example, FIG. 11 shows notch 301. Notch 301 is inserted into indentation 398 of inner body 2 (FIG. 14).

Use of Anti-Tampering Mechanism with Cabinet Style Lock

Figure 13A:
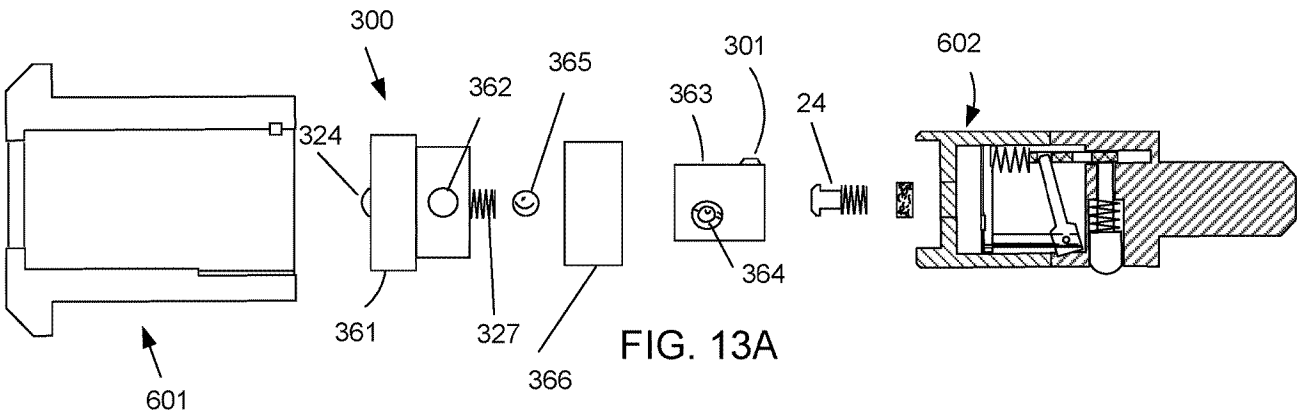
Figure 13B:
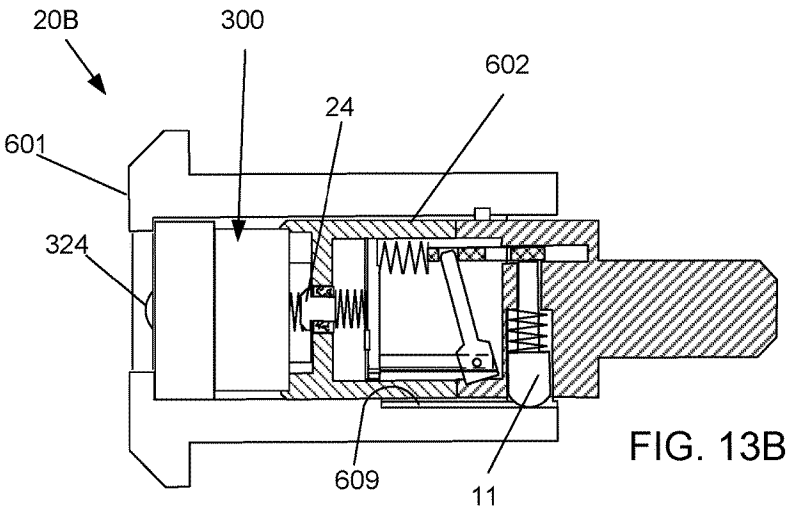

Housing 601 (FIGS. 13A-13B) is a lock housing that is preferable for a cabinet style lock. Anti-tampering mechanism 300 is securely held in place and sandwiched tightly between housing 601 and cylinder 602 (FIG. 13B). To unlock lock 20B (FIG. 13B), key 30 is inserted into lock 20B so that nodule 97 of key 30 is aligned with indentation 322 of anti-tampering mechanism 300. Contact tip 33 of key 30 makes contact with contact pin 324. An electrical signal is transmitted from contact tip 33 through contact pin 324 and then through contact spring 327 to contact pin 24. Lock 20B is then unlocked in a fashion similar to that described above in reference to earlier described embodiments.

Figures 12A, 12B:
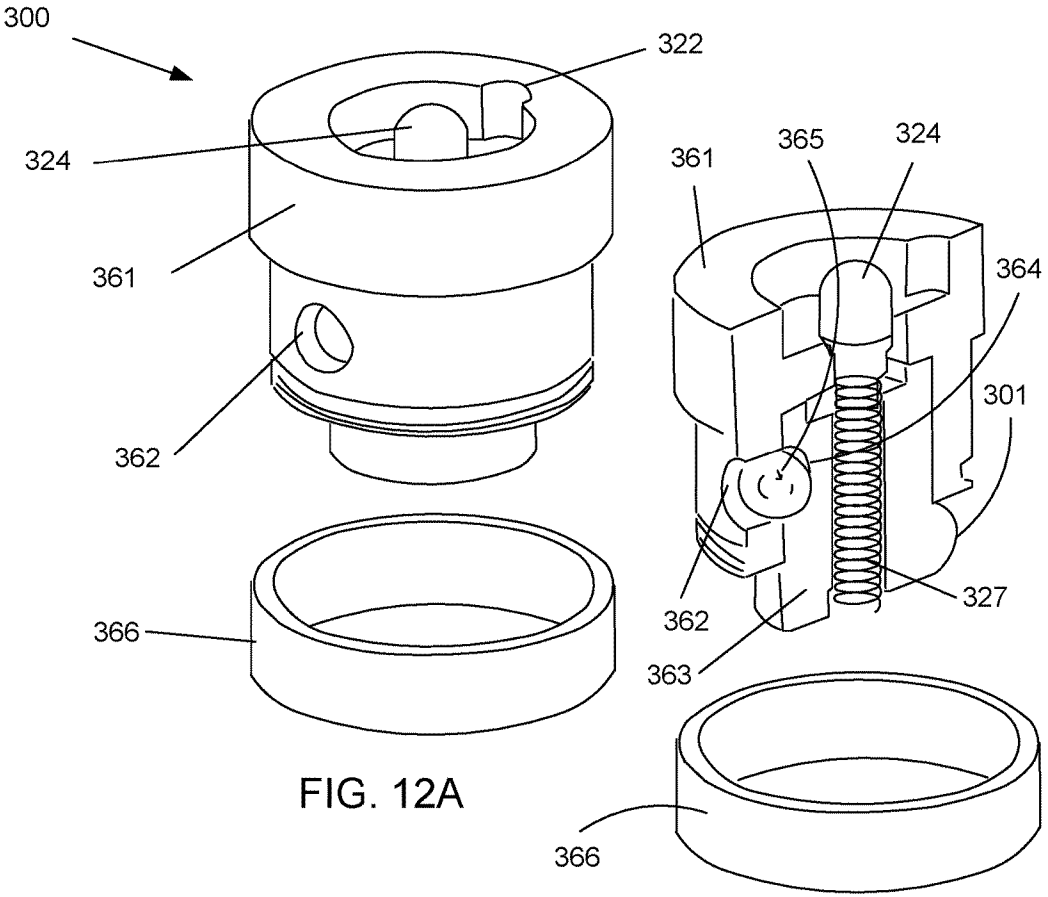

Anti-tampering mechanism 300 is designed to prevent a thief from turning cylinder 602 by force to open lock 20B. FIGS. 12A and 12B both show anti-tampering mechanism 300 with body 361. Body 361 includes hole 362. Key extension portion 363 is inserted inside body 361 as shown and includes nodule 301. Key extension portion 363 is free to rotate within anti-tampering mechanism body 300 unless rigidly secured by ball 365. Contact spring 327 is connected to contact pin 324 and extends through the center of key extension portion 363. Ball 365 is inserted into hole 362 and engages with indention 364 in key extension portion 363. Ball 365 is held tightly in place by flexible band 366. Flexible band 366 is slid over body 361 as shown. Ball 365 inserted through hole 362 and engaged with indention 364 prevents relative motion between body 361 and key extension portion 363.

As stated above, anti-tampering mechanism 300 is designed to prevent a thief from turning 602 by force to open lock 20B. Unless the proper code is transmitted, locking pin 11 will not move upwards and move clear of indentation 609 of housing 601 (FIG. 13). If a thief, nevertheless, attempts to turn his key, flexible band 366 will allow ball 365 to be moved from tapered indentation 364 in key extension portion 363 while simultaneously retaining ball 365 in hole 362. Body 361 with then turn freely while key extension portion 363 remains stationary. The thief will then be frustrated and most likely abandon further attempts to break open the lock.

Lock 20B is easily returned to full operational functionality. To restore the lock, the user only needs to continue to rotate body 361 until ball 365 is moved back over indention 364. Band 366 will hold ball 365 in the appropriate position as described above so that it is engaged with indention 364.

Use of Anti-Tampering Mechanism with Padlock

Figure 15:
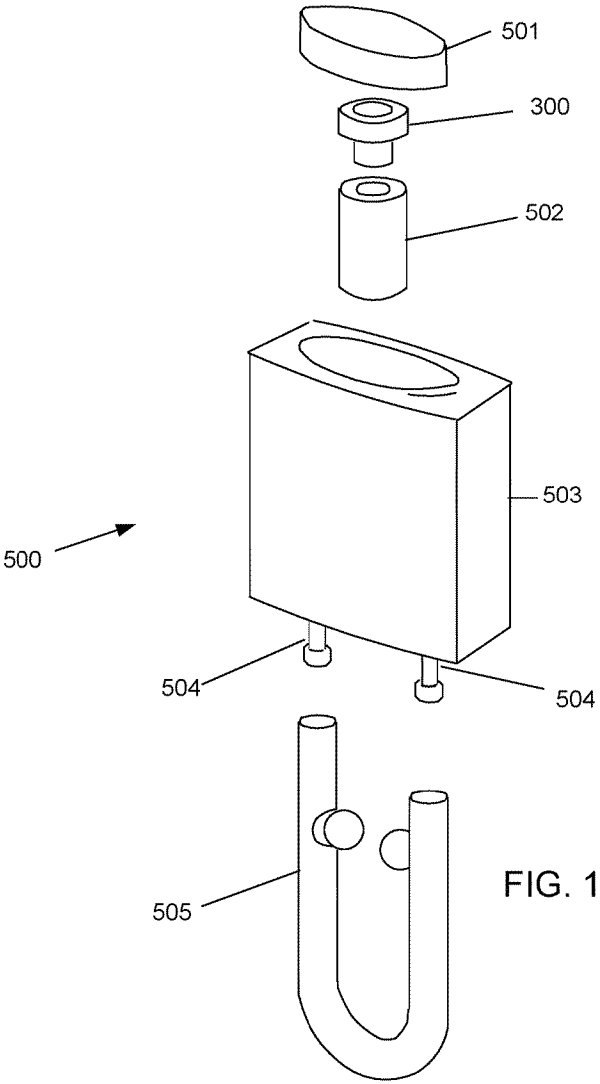
FIGS. 15-17 show another preferred embodiment of the present invention.
Figure 16:
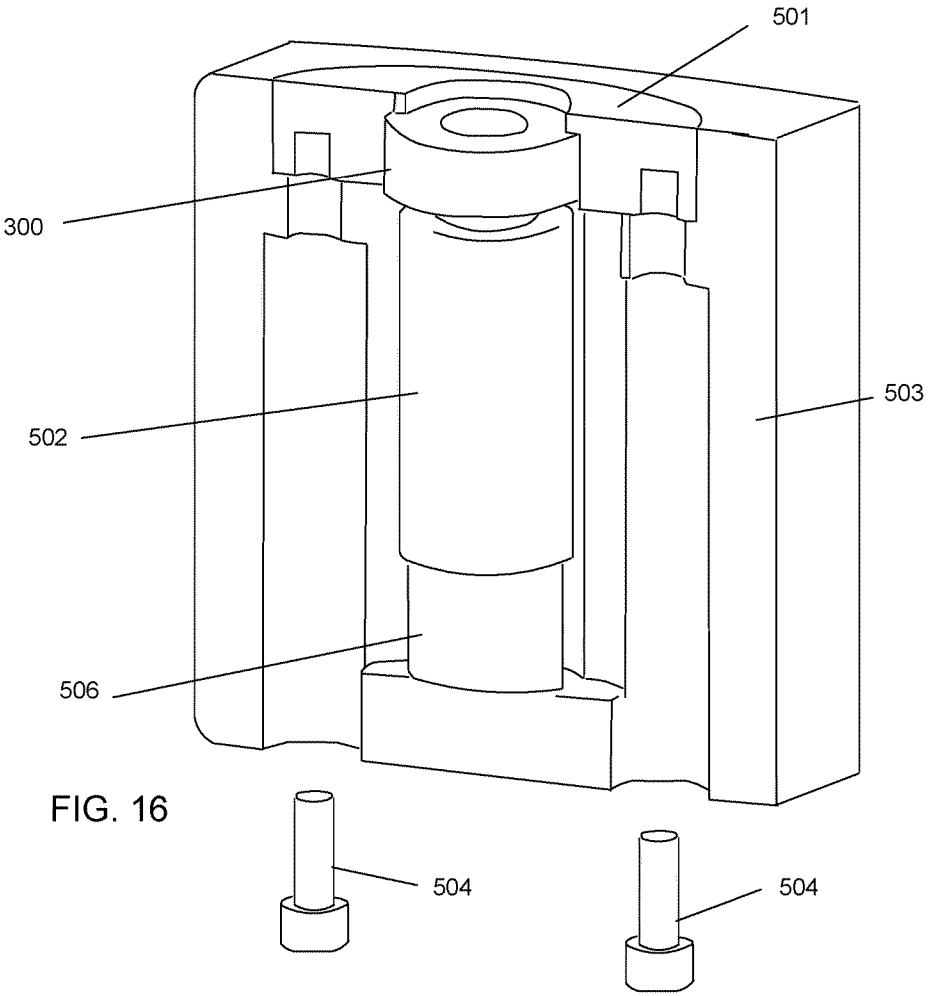
Figure 17:
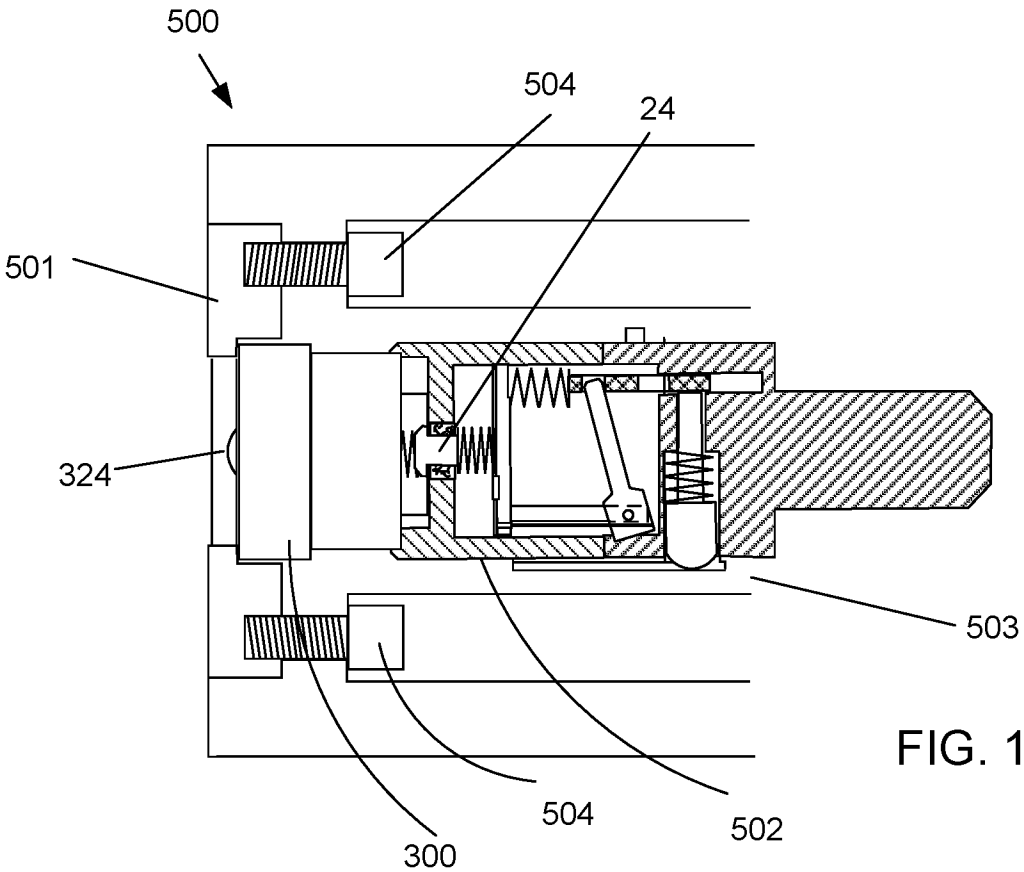

FIGS. 15-17 show the utilization of anti-tampering mechanism 300 in conjunction with padlock 500. Padlock 500 includes retaining face 501, anti-tampering mechanism 300, cylinder 502, padlock housing 503, face retaining screws 504, cylinder drive 506 and shackle 505.

Retaining face 501 has been secured rigidly to housing 503 by use of face retaining screws 504. Anti-tampering mechanism 300 is securely held in place and sandwiched tightly between retaining face 501 and cylinder 502. To unlock padlock 500, key 30 is inserted into lock 500 so that nodule 97 of key 30 is aligned with indentation 322 of anti-tampering mechanism 300. Contact tip 33 of key 30 makes contact with contact pin 324. An electrical signal is transmitted from contact tip 33 through contact pin 324 and then through contact spring 327 to contact pin 24. Lock 20B is then unlocked in a fashion similar to that described above in reference to earlier described embodiments.

Although the above-preferred embodiments have been described with specificity, persons skilled in this art will recognize that many changes to the specific embodiments disclosed above could be made without departing from the spirit of the invention. Therefore, the attached claims and their legal equivalents should determine the scope of the invention.

What is claimed is:

1. A lock with anti-tampering mechanism, comprising:

A. a lock housing having a housing indentation,

B. cylinder rotatably housed within said housing,

C. a locking pin connected to said cylinder and inserted into said housing indention when said lock is locked and clear of said housing indentation when said lock in unlocked, and D. an anti-tampering mechanism positioned between said housing and said cylinder, said anti-tampering mechanism comprising:

A. an anti-tampering mechanism body for receiving a user's key, said anti-tampering mechanism comprising a relative motion hole, B. a key extension portion rotatably inserted inside said anti-tampering mechanism body and comprising a relative motion indentation, said key extension portion being keyed to said cylinder, C. a lock ball inserted into said relative motion hole and said relative motion indention, said lock ball preventing relative motion between said anti-tampering mechanism body and said key extension portion, and D. a flexible band wrapped around said anti-tampering mechanism body and covering said lock ball and holding said lock ball in place in said relative motion hole and said relative motion indention, wherein said lock ball leaves said relative motion indention and said flexible band retains said lock ball in said relative motion hole if said anti-tampering mechanism body is rotated while said locking pin is inserted into said housing indentation, thereby permitting relative motion between said anti-tampering mechanism body and said key extension portion.

2. The lock as in claim 1, further comprising:

A. an anti-tampering mechanism contact pin extending upwards from said anti-tampering mechanism body and for receiving an electrical signal from said user's key, and B. an anti-tampering mechanism contact spring extending downward from said anti-tampering mechanism contact pin and for transmitting said electrical signal to said cylinder.

3. The lock as in claim 2, further comprising:

A. a cylinder contact pin connected to said cylinder, and in contact with said anti-tampering mechanism contact spring B. a printed circuit board frame rigidly connected to said cylinder, C. a printed circuit board connected to said printed circuit board frame, D. a driver arm support bracket rigidly connected to said printed circuit board frame, E. a lock microprocessor connected to said printed circuit board and electrically connected to said cylinder contact pin, F. a key identification code verification database in electrical connectivity with said lock microprocessor, G. a nitinol wire electrically connected to said lock microprocessor, H. a driver arm pivotally connected to said driver arm support bracket, wherein said nitinol wire is connected to said driver arm, I. a jam plate connected to said driver arm, J. a jam plate return spring connected to said jam plate and said printed circuit board frame, and wherein said locking pin is covered by said jam plate and inserted into said housing indentation when said electrical mechanical device is locked and wherein said locking pin is not covered by said jam plate and is clear of said housing indentation when said electrical mechanical device is unlocked, and K. a key microprocessor within said user's key, L. a power source electrically connected to said key microprocessor, M. a database electrically connected to said key microprocessor, said database comprising a key identification code for identifying said key, and N. a contact tip electrically connected to said key microprocessor, said contact tip for insertion into said lock.

4. The electrical mechanical locking device as in claim 3, wherein said lock is unlocked by:

A. inserting said key into said lock,

B. transmitting said key identification code to said lock microprocessor,

C. verifying said key identification code at said key identification code verification database, D. transmitting an electrical signal from said lock microprocessor to said electrical actuator after said verification of said key identification code, E. contracting said electrical actuator, F. pulling said driver arm, G. uncovering said jam plate from said locking pin, H. turning said key, and I. clearing said locking pin from said housing indentation.

5. The electrical mechanical locking device as in claim 3, wherein said cylinder comprises:

J. an upper inner body, and

K. a lower inner body rigidly connected to said upper inner body with breakaway tabs.

6. The electrical mechanical locking device as claim 3, wherein said electrical actuator wire is a nitinol wire.

7. The electrical mechanical locking device as in claim 6, further comprising:

L. nitinol wire crimps, wherein said nitinol wire is connected to said printed circuit board frame via said nitinol wire crimps, and M. low melt solder, wherein said nitinol wire crimps are mounted to said cylinder via said low melt solder.

8. The electrical mechanical locking device as in claim 3 wherein said driver arm is flexible.

9. The electrical mechanical locking device as in claim 3, wherein said lock further comprises a lock face, wherein said driver arm moves away from said lock face to unlock said lock.

* * * * *